US008476967B2

(12) United States Patent
Kobayashi et al.

(10) Patent No.: US 8,476,967 B2
(45) Date of Patent: Jul. 2, 2013

(54) CONSTANT CURRENT CIRCUIT AND REFERENCE VOLTAGE CIRCUIT

(75) Inventors: Yuji Kobayashi, Chiba (JP); Takashi Imura, Chiba (JP); Masakazu Sugiura, Chiba (JP); Atsushi Igarashi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 64 days.

(21) Appl. No.: 13/292,451

(22) Filed: Nov. 9, 2011

(65) Prior Publication Data

US 2012/0126873 A1 May 24, 2012

(30) Foreign Application Priority Data

Nov. 24, 2010 (JP) ..... 2010-261718

(51) Int. Cl.
*G05F 1/575* (2006.01)

(52) U.S. Cl.
USPC ..... 327/543; 327/541; 323/314; 323/316

(58) Field of Classification Search
None
See application file for complete search history.

(56) References Cited

U.S. PATENT DOCUMENTS

| | | | | |
|---|---|---|---|---|
| 4,654,578 | A * | 3/1987 | Salerno et al. | 323/313 |
| 5,686,824 | A * | 11/1997 | Rapp | 323/313 |
| 6,034,567 | A * | 3/2000 | Umezawa et al. | 330/253 |
| 8,013,588 | B2 * | 9/2011 | Imura | 323/313 |
| 8,174,309 | B2 * | 5/2012 | Yoshino et al. | 327/541 |
| 8,188,785 | B2 * | 5/2012 | Iacob et al. | 327/543 |
| 2012/0032312 | A1 * | 2/2012 | Nogami et al. | 257/653 |

FOREIGN PATENT DOCUMENTS

JP 03-238513 A 10/1991

* cited by examiner

*Primary Examiner* — Lincoln Donovan
*Assistant Examiner* — Terry L Englund
(74) *Attorney, Agent, or Firm* — Brinks Hofer Gilson & Lione

(57) ABSTRACT

Provided is a constant current circuit and a reference voltage circuit with improved line regulation without needing a start-up circuit. The constant current circuit includes: a constant current generation circuit including NMOS transistors and a resistor; a current mirror circuit including a pair of depletion mode NMOS transistors, for allowing a current of the constant current generation circuit to flow; and a feedback circuit for maintaining constant voltages of source terminals of the pair of depletion mode NMOS transistors.

6 Claims, 9 Drawing Sheets

CONSTANT CURRENT CIRCUIT AND REFERENCE VOLTAGE CIRCUIT

RELATED APPLICATIONS

This application claims priority under 35 U.S.C. §119 to Japanese Patent Application No. 2010-261718 filed on Nov. 24, 2010, the entire content of which is hereby incorporated by reference.

BACKGROUND OF THE INVENTION

1. Field of the Invention

The present invention relates to a constant current circuit and a reference voltage circuit using the same, and more particularly, to stabilizing operation of a constant current circuit.

2. Description of the Related Art

A conventional constant current circuit is described. FIG. 9 is a circuit diagram illustrating a conventional constant current circuit using the difference in K-value (drivability). The K-value is determined by $K=W/L\cdot(\mu Cox/2)$, where W is the gate width, L is the gate length, μ is the mobility of carriers, and Cox is the gate oxide capacitance per unit area.

The conventional constant current circuit includes enhancement mode NMOS transistors 91 and 92 having different K-values, enhancement mode PMOS transistors 93 and 94, and a resistor 95.

The enhancement mode NMOS transistor 91 has a source terminal connected to a ground terminal 100 having a minimum potential, and a drain terminal and a gate terminal which are both connected to a gate terminal of the enhancement mode NMOS transistor 92 and a drain terminal of the enhancement mode PMOS transistor 93. The enhancement mode NMOS transistor 92 has a source terminal connected to the ground terminal 100 via the resistor 95, and a drain terminal connected to a gate terminal and a drain terminal of the enhancement mode PMOS transistor 94 and a gate terminal of the enhancement mode PMOS transistor 93. The enhancement mode PMOS transistors 93 and 94 each have a source terminal connected to a power supply terminal 101 having a maximum potential.

Next, an operation of the conventional constant current circuit is described. The K-value of the enhancement mode NMOS transistor 91 is smaller than the K-value of the enhancement mode NMOS transistor 92. A voltage difference between a gate-source voltage of the enhancement mode NMOS transistor 91 and a gate-source voltage of the enhancement mode NMOS transistor 92 is generated across the resistor 95. A current flowing through the resistor 95 is mirrored by the enhancement mode PMOS transistors 93 and 94, thereby generating a bias current (see, for example, Japanese Patent Application Laid-open No. Hei 03-238513).

However, the conventional constant current circuit has two operating points. One is a normal operating point at which the bias current flows. The other is an operating point at which the bias current becomes 0. When a potential at a connection point 291 becomes the maximum potential of the power supply terminal 101 and a potential at a connection point 290 becomes the minimum potential of the ground terminal 100, the constant current circuit is fixed at the operating point at which the bias current becomes 0, and thus fails to operate. The conventional constant current circuit has therefore a problem of needing a separate start-up circuit for start-up.

In addition, when the potential of the power supply terminal 101 increases and then the potential at the connection point 291 increases, the characteristics of the enhancement mode NMOS transistors 91 and 92 are changed by the channel length modulation effect of the enhancement mode NMOS transistor 92, with the result that the bias current fluctuates. In other words, the conventional constant current circuit has a problem of poor line regulation.

SUMMARY OF THE INVENTION

The present invention has been made in view of the above-mentioned problems, and provides a constant current circuit with improved line regulation without needing a start-up circuit.

In order to solve the above-mentioned problems, a constant current circuit according to the present invention includes: a constant current generation circuit including NMOS transistors and a resistor; a current mirror circuit including a pair of depletion mode NMOS transistors including gate terminals connected to each other, for allowing a current of the constant current generation circuit to flow; and a feedback circuit for maintaining constant voltages of source terminals of the pair of depletion mode NMOS transistors.

According to the constant current circuit of the present invention, the depletion mode NMOS transistors are used in the current mirror circuit, thus enabling the constant current circuit to start up in a state in which a channel is formed. Accordingly, the constant current circuit reliably starts up without being stable at an operating point at which a bias current becomes 0. Therefore, the constant current circuit does not need a start-up circuit. In addition, by providing the differential amplifier circuit, the changes in drain voltages of enhancement mode NMOS transistors are fed back equally, and hence drain currents of the depletion mode NMOS transistors are determined only by the ratio W/L. Therefore, line regulation can be further improved by increasing the gain characteristics of the feedback loop.

DETAILED DESCRIPTION OF THE PREFERRED EMBODIMENT

Figure 1:
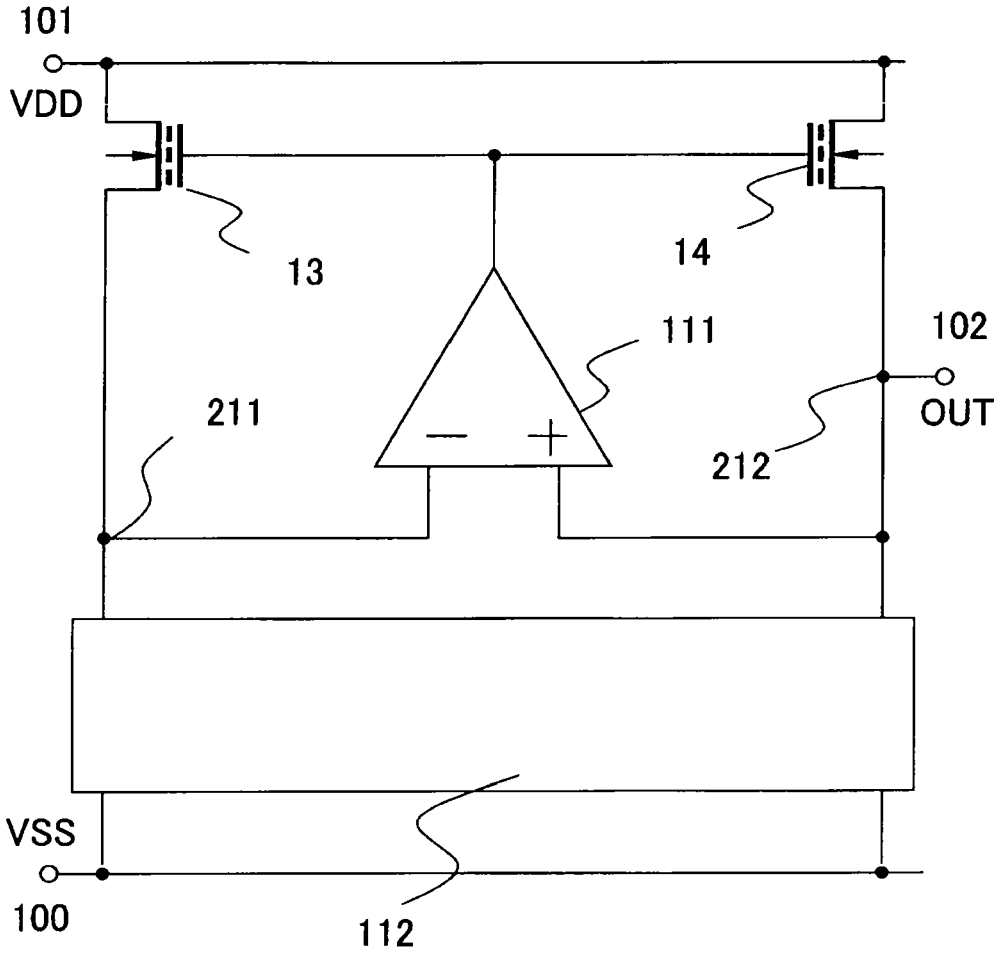
FIG. 1 is a block diagram illustrating a constant current circuit according to the present invention.

FIG. 1 is a block diagram illustrating a constant current circuit according to the present invention.

The constant current circuit according to the present invention includes a constant current generation block circuit 112, a differential amplifier circuit 111, and depletion mode NMOS transistors 13 and 14.

The differential amplifier circuit 111 has an output terminal connected to gate terminals of the depletion mode NMOS transistors 13 and 14, an inverting input terminal connected to a source terminal of the depletion mode NMOS transistor 13 and the constant current generation block circuit 112, and a non-inverting input terminal connected to a source terminal of the depletion mode NMOS transistor 14 and the constant current generation block circuit 112. The constant current generation block circuit 112 is connected between the source terminals of the depletion mode NMOS transistors 13 and 14 and a ground terminal 100. The depletion mode NMOS transistors 13 and 14 each have a drain terminal and a substrate which are connected to a power supply terminal 101. The source terminal of the depletion mode NMOS transistor 14 is connected to a constant current output terminal 102 of the constant current circuit.

The constant current generation block circuit 112 is a constant current circuit formed by enhancement mode NMOS transistors and a resistor. The constant current generation block circuit 112 is formed by, for example, a circuit of FIG. 2 or FIG. 3.

Figure 2:
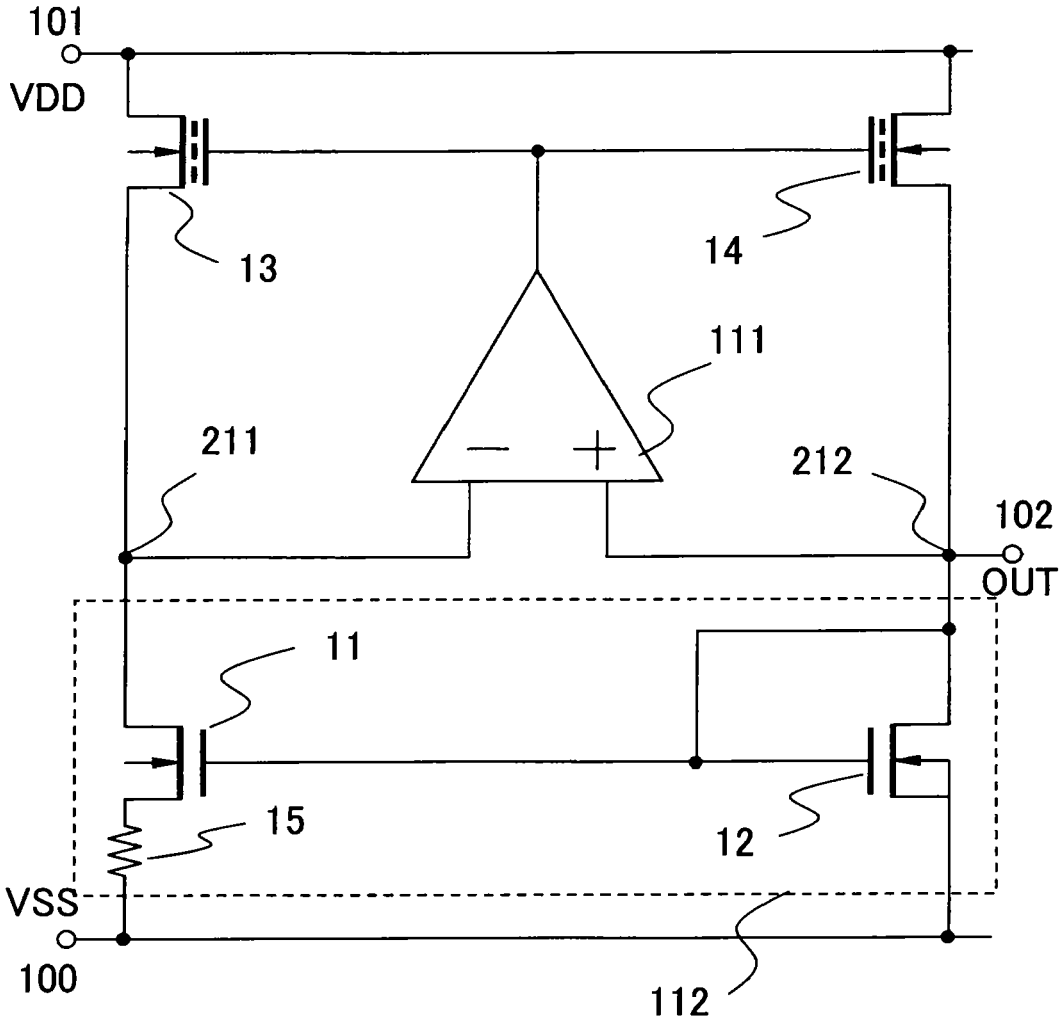
FIG. 2 is a circuit diagram of the constant current circuit, illustrating a specific example of a constant current source block circuit.

The constant current source block circuit 112 of FIG. 2 includes enhancement mode NMOS transistors 11 and 12 having gate terminals connected to each other, and a resistor 15. The enhancement mode NMOS transistor 11 has a drain terminal connected to the source terminal of the first depletion mode NMOS transistor 13, and a source terminal connected to the ground terminal 100 via the resistor 15. The enhancement mode NMOS transistor 12 has a gate terminal and a drain terminal which are connected to the source terminal of the second depletion mode NMOS transistor 14, and a source terminal connected to the ground terminal 100.

A current flowing through the enhancement mode NMOS transistor 11 is equal to a current flowing through the depletion mode NMOS transistor 13. A current flowing through the enhancement mode NMOS transistor 12 is equal to a current flowing through the depletion mode NMOS transistor 14. Further, the ratio between a K-value of the enhancement mode NMOS transistor 11 and a K-value of the enhancement mode NMOS transistor 12 is different from the ratio between a K-value of the depletion mode NMOS transistor 13 and a K-value of the depletion mode NMOS transistor 14. Therefore, a bias current is generated by applying a difference voltage between a gate-source voltage of the enhancement mode NMOS transistor 11 and a gate-source voltage of the enhancement mode NMOS transistor 12 to the resistor 15.

Figure 3:
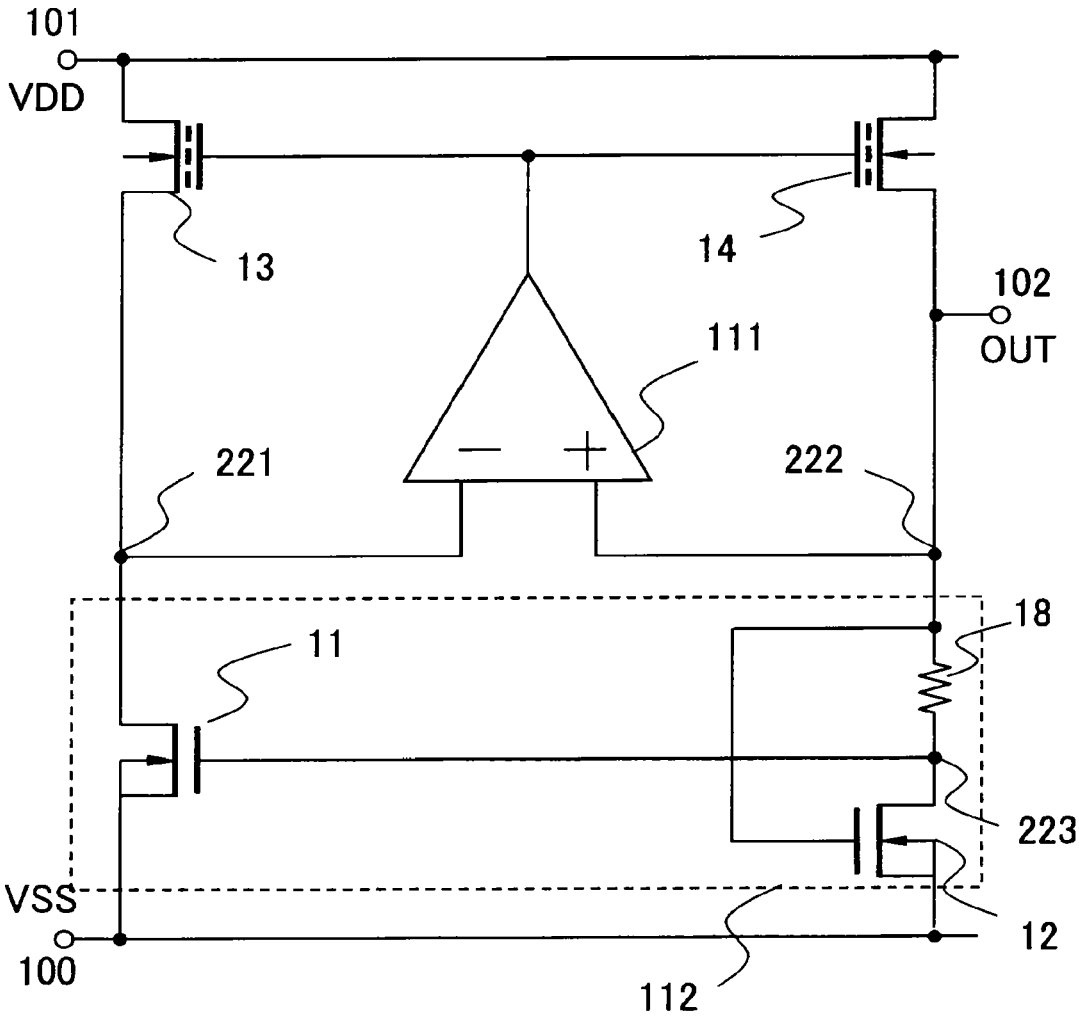
FIG. 3 is a circuit diagram of the constant current circuit, illustrating another specific example of the constant current source block circuit.

The constant current source block circuit 112 of FIG. 3 includes enhancement mode NMOS transistors 11 and 12 and a resistor 18. The enhancement mode NMOS transistor 11 has a gate terminal connected to a drain terminal of the enhancement mode NMOS transistor 12, a drain terminal connected to the source terminal of the first depletion mode NMOS transistor 13, and a source terminal connected to the ground terminal 100. The enhancement mode NMOS transistor 12 has a gate terminal connected to the source terminal of the second depletion mode NMOS transistor 14, a drain terminal connected to the source terminal of the second depletion mode NMOS transistor 14 via the resistor 18, and a source terminal connected to the ground terminal 100.

The constant current source block circuit 112 of FIG. 3 is different from that of FIG. 2 in the circuit configuration in which a difference voltage between a gate-drain voltage of the enhancement mode NMOS transistor 11 and a gate-drain voltage of the enhancement mode NMOS transistor 12 is generated across the resistor 18 to generate a bias current.

Here, the enhancement mode NMOS transistors 11 and 12 may be formed by a plurality of transistors connected in parallel.

Next, an operation of the constant current circuit according to the present invention is described.

The depletion mode NMOS transistors 13 and 14 together form a current mirror circuit. The depletion mode NMOS transistors 13 and 14 each allow a drain current to flow through the constant current generation block circuit 112 when a voltage equal to or higher than a threshold voltage is applied between the gate terminal and the source terminal. The use of the depletion mode NMOS transistors in the current mirror circuit enables the constant current circuit to start up in a state in which a channel is formed, thereby preventing the constant current circuit from being stable at an operating point at which the bias current becomes 0.

The differential amplifier circuit 111 provides negative feedback to a gate terminal of the depletion mode NMOS transistor 13 so that source voltages of the depletion mode NMOS transistors 13 and 14 for allowing the bias current to flow may be equal to each other. Therefore, when the voltage of the power supply terminal changes and then the source voltage of the depletion mode NMOS transistor 13 increases to increase the bias current, negative feedback is applied by the differential amplifier circuit 111 to decrease the gate voltage of the depletion mode NMOS transistor 13 and reduce the bias current. In other words, by using the differential amplifier circuit, line regulation can be maintained high.

As described above, the constant current circuit according to the present invention uses the depletion mode NMOS transistors in the current mirror circuit, thus enabling the constant current circuit to start up reliably without being stable at the operating point at which the bias current becomes 0. Therefore, no start-up circuit is required. Besides, by using the differential amplifier circuit 111, the same potential can be obtained at a connection point 211 and a connection point 212 to maintain high line regulation.

Figure 4:
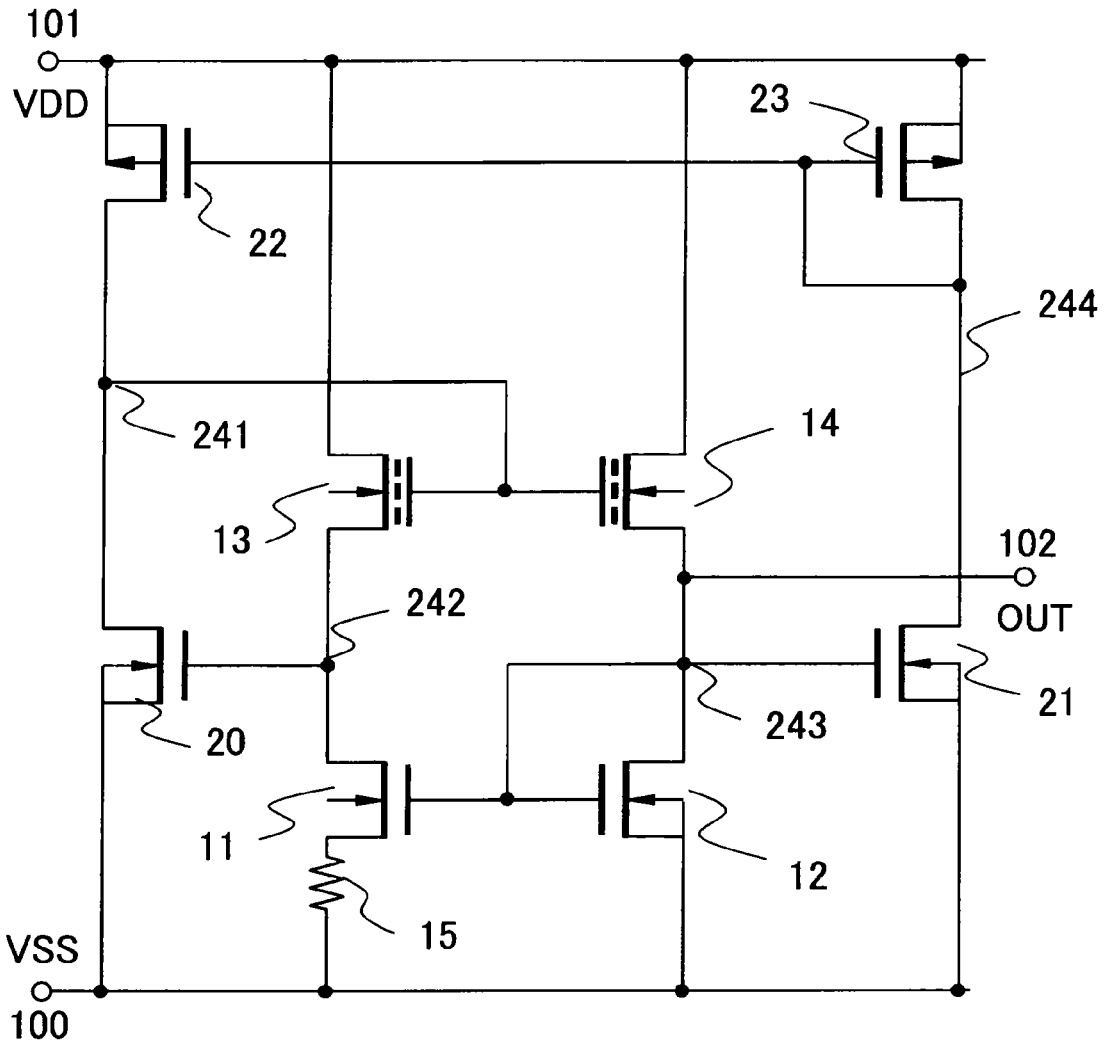
FIG. 4 is a circuit diagram of the constant current circuit, illustrating a specific configuration example of a differential amplifier circuit.

FIG. 4 is a circuit diagram of the constant current circuit, illustrating a specific configuration example of the differential amplifier circuit 111.

The constant current circuit of FIG. 4 includes the enhancement mode NMOS transistors 11 and 12 and the resistor 15, which form the constant current source block circuit 112, the depletion mode NMOS transistors 13 and 14, and enhancement mode NMOS transistors 20 and 21 and enhancement mode PMOS transistors 22 and 23, which form the differential amplifier circuit 111.

The constant current source block circuit 112 has the same configuration as that of FIG. 2. The differential amplifier circuit 111 is configured as follows.

The enhancement mode PMOS transistor 22 has a gate terminal connected to a gate terminal of the enhancement mode PMOS transistor 23, and a drain terminal connected to a drain terminal of the enhancement mode NMOS transistor 20. The enhancement mode PMOS transistor 23 has a drain terminal and the gate terminal which are connected to a drain terminal of the enhancement mode NMOS transistor 21. The enhancement mode NMOS transistor 20 has a gate terminal connected to a connection point 242. The enhancement mode NMOS transistor 21 has a gate terminal connected to a connection point 243. The enhancement mode NMOS transistors 20 and 21 each have a source terminal and a substrate which are connected to the ground terminal 100. The enhancement mode PMOS transistors 22 and 23 each have a source terminal and a substrate which are connected to the power supply terminal 101.

A connection point 241 corresponds to the output terminal of the differential amplifier circuit 111. The connection point 242 corresponds to the inverting input terminal of the differential amplifier circuit 111. The connection point 243 corresponds to the non-inverting input terminal of the differential amplifier circuit 111. The enhancement mode NMOS transistor 20 is a non-inverting input terminal stage transistor, the enhancement mode NMOS transistor 21 is an inverting input terminal stage transistor, and the enhancement mode PMOS transistors 22 and 23 are a current mirror circuit.

Next, an operation of the constant current circuit of FIG. 4 is described.

When the potential of the power supply terminal 101 fluctuates and then the potential of the connection point 242 corresponding to the inverting input terminal increases, a gate-source voltage of the enhancement mode NMOS transistor 20 increases to increase a drain current. Accordingly, the potential of the connection point 241 corresponding to the drain terminal of the enhancement mode NMOS transistor 20 and the output terminal of the differential amplifier circuit decreases to decrease the gate voltages of the depletion mode NMOS transistors 13 and 14. In other words, negative feedback is applied to the depletion mode NMOS transistors 13 and 14 so that the potential of the connection point 243 and the potential of the connection point 242 can be maintained to the same potential.

As described above, by providing the differential amplifier circuit illustrated in FIG. 4, the same potential can be obtained at the connection point 242 and the connection point 243 to maintain high line regulation. Besides, the depletion mode NMOS transistors are used as the current mirror circuit, thus enabling the constant current circuit to start up reliably without a start-up circuit.

Figure 5:
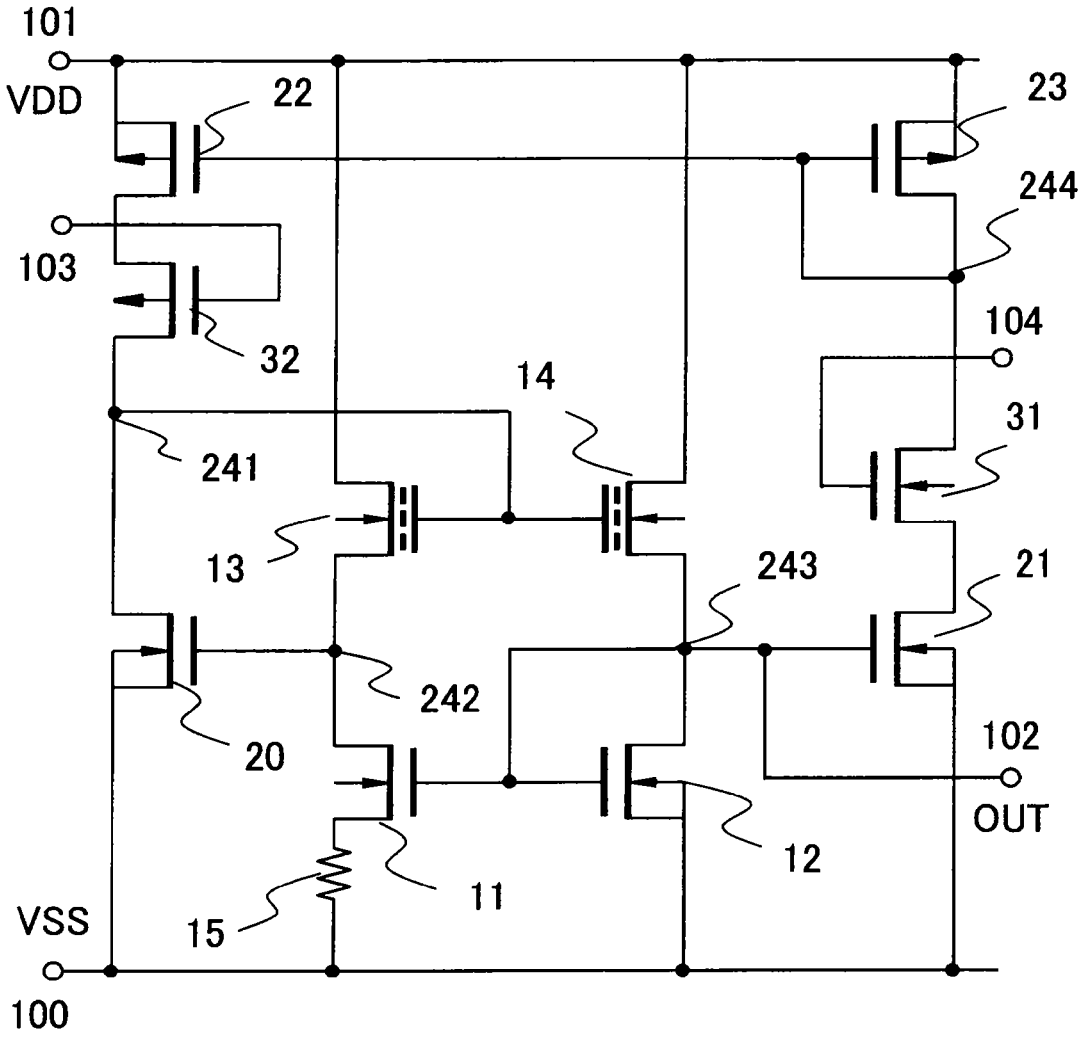
FIG. 5 is a circuit diagram of the constant current circuit, illustrating another configuration example of the differential amplifier circuit.

FIG. 5 is a circuit diagram of the constant current circuit, illustrating another configuration example of the differential amplifier circuit 111.

The constant current circuit of FIG. 5 includes the enhancement mode NMOS transistors 11 and 12 and the resistor 15, which form the constant current source block circuit 112, the depletion mode NMOS transistors 13 and 14, and enhancement mode NMOS transistors 20, 21, and 31 and enhancement mode PMOS transistors 22, 23, and 32, which form the differential amplifier circuit 111.

The constant current source block circuit 112 has the same configuration as that of FIG. 2. The differential amplifier circuit 111 is realized by adding a cascode circuit of the enhancement mode NMOS transistor 31 and a cascode circuit of the enhancement mode PMOS transistor 32 to the differential amplifier circuit 111 of FIG. 4.

The enhancement mode PMOS transistor 32 is provided between a drain terminal of the enhancement mode PMOS transistor 22 and a drain terminal of the enhancement mode NMOS transistor 20, and has a gate terminal connected to a P-channel cascode terminal 103. The enhancement mode NMOS transistor 31 is provided between a drain terminal of the enhancement mode PMOS transistor 23 and a drain terminal of the enhancement mode NMOS transistor 21, and has a gate terminal connected to an N-channel cascode terminal 104. The P-channel cascode terminal 103 is applied with a constant voltage based on the power supply potential. The N-channel cascode terminal 104 is applied with a constant voltage based on the ground potential.

Next, an operation of the constant current circuit of FIG. 5 is described.

When the potential of the power supply terminal 101 fluctuates and then the potential of the connection point 242 corresponding to the inverting input terminal increases, the constant current circuit operates in the same manner as that of FIG. 4, but the cascode circuit of the enhancement mode PMOS transistor 32 suppresses the channel length modulation effect of the enhancement mode PMOS transistor 22 and the cascode circuit of the enhancement mode NMOS transistor 31 suppresses the channel length modulation effect of the enhancement mode NMOS transistor 21. Therefore, the gain characteristics of the differential amplifier circuit 111 are improved, and the line regulation is improved more as compared to the constant current circuit of FIG. 4.

Figure 6:
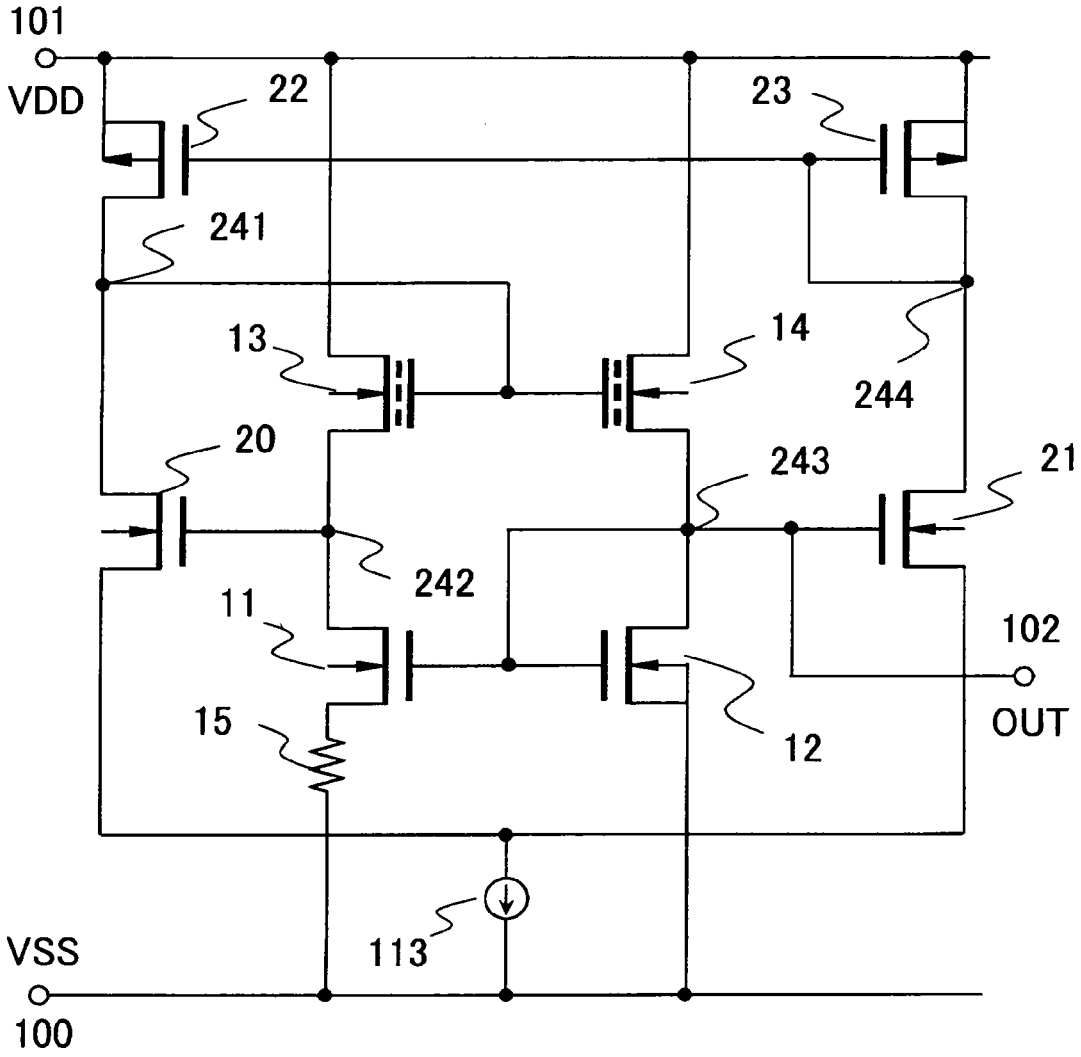
FIG. 6 is a circuit diagram of the constant current circuit, illustrating still another configuration example of the differential amplifier circuit.

FIG. 6 is a circuit diagram of the constant current circuit, illustrating still another configuration example of the differential amplifier circuit 111.

The constant current circuit of FIG. 6 includes the enhancement mode NMOS transistors 11 and 12 and the resistor 15, which form the constant current source block circuit 112, the depletion mode NMOS transistors 13 and 14, and enhancement mode NMOS transistors 20 and 21, enhancement mode PMOS transistors 22 and 23, and a constant current source 113, which form the differential amplifier circuit 111.

The difference from the constant current circuit of FIG. 4 resides in that the source terminals of the enhancement mode NMOS transistors 20 and 21 provided at the input stage of the differential amplifier circuit 111 are connected to the constant current source 113. The use of the constant current source 113 enables control of a consumption current value of the differential amplifier circuit 111.

Figure 7:
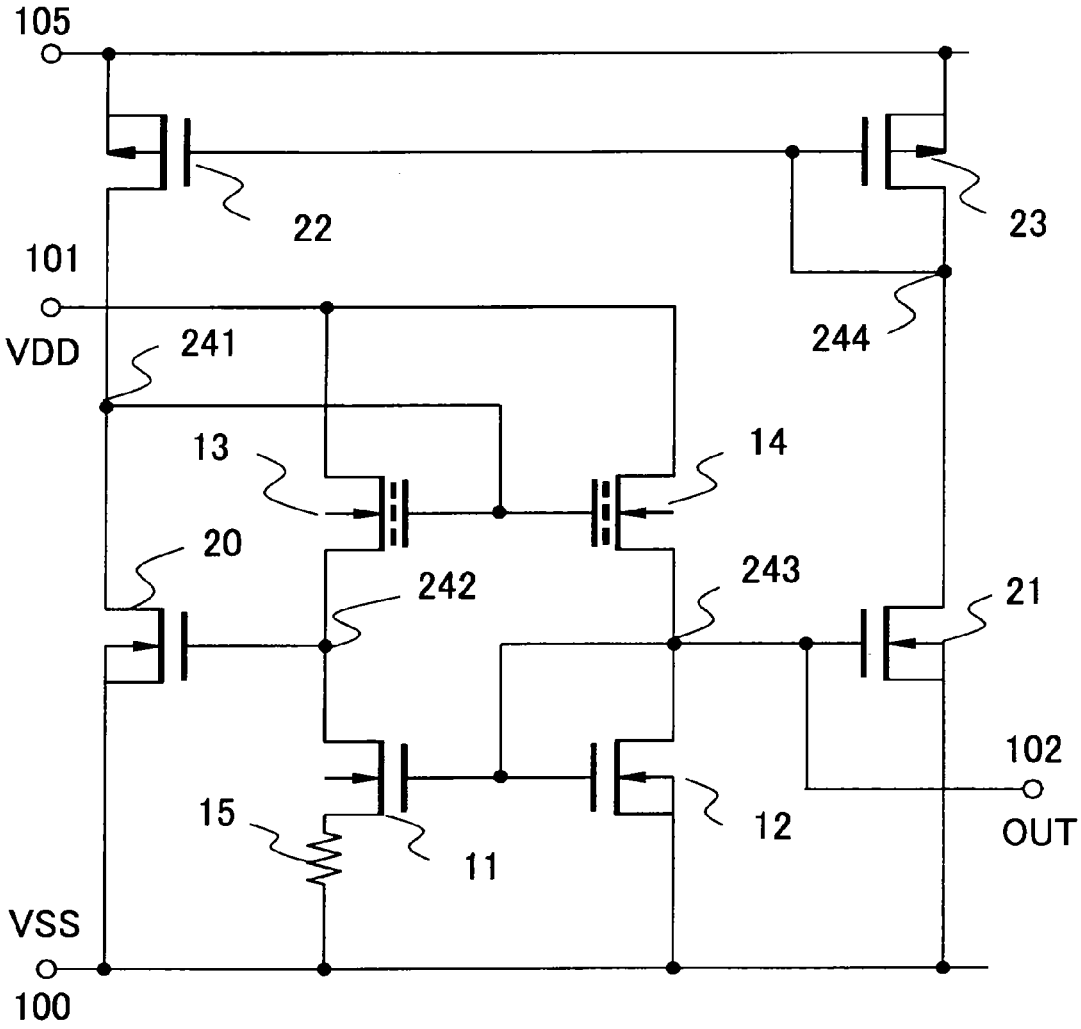
FIG. 7 is a circuit diagram of the constant current circuit, illustrating a further configuration example of the differential amplifier circuit.

FIG. 7 is a circuit diagram of the constant current circuit, illustrating a further example of the differential amplifier circuit 111.

In the constant current circuit of FIG. 7, the drain terminals of the depletion mode NMOS transistors 13 and 14 are connected to the power supply terminal 101, and source terminals of enhancement mode PMOS transistors 22 and 23 are connected to a second power supply terminal 105.

The power supply of the differential amplifier circuit 111 and the power supply of the circuit for generating a bias current may be separate unless a voltage less than a threshold voltage of the depletion mode NMOS transistors 13 and 14 is applied as a gate-source voltage of the depletion mode NMOS transistors 13 and 14.

In the constant current circuit configured as illustrated in FIG. 7, a potential of the second power supply terminal 105 is made constant with respect to the power supply terminal 101, thus improving the line regulation.

Figure 8:
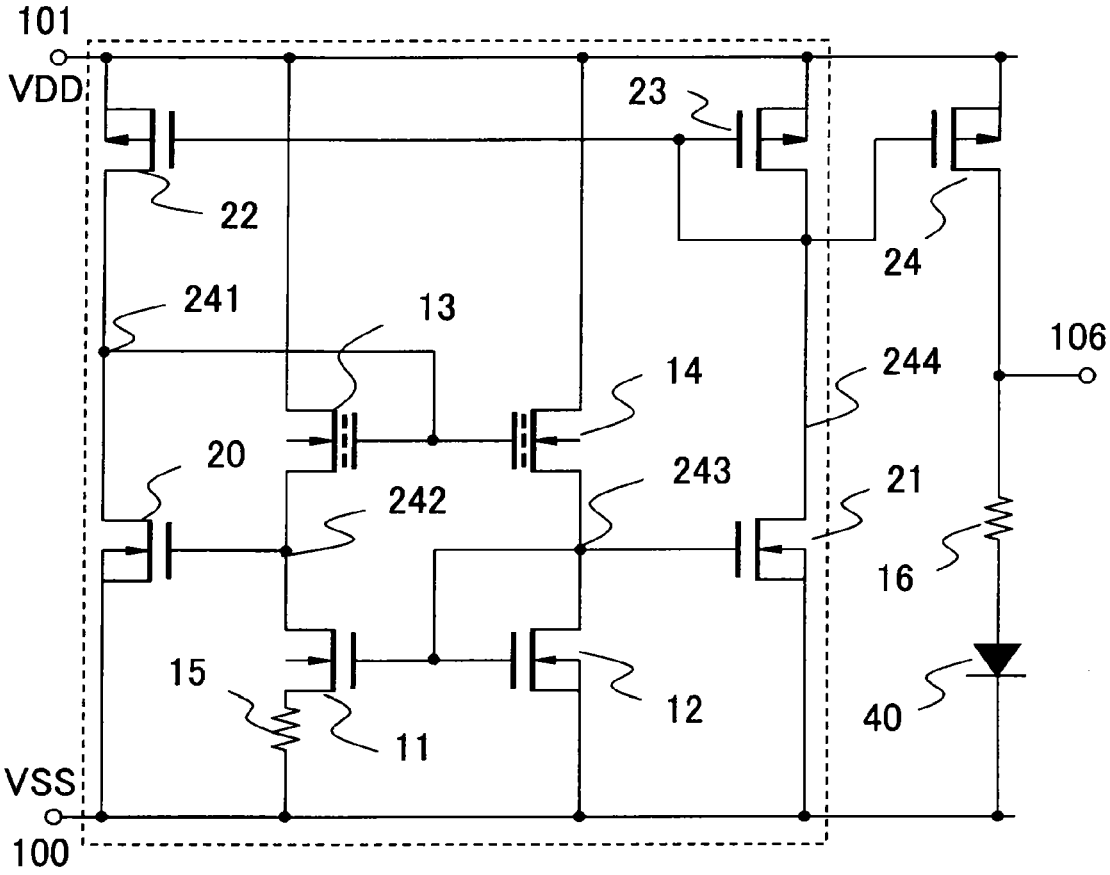
FIG. 8 is a circuit diagram illustrating an example of a reference voltage circuit using the constant current circuit according to the present invention.
Figure 9:
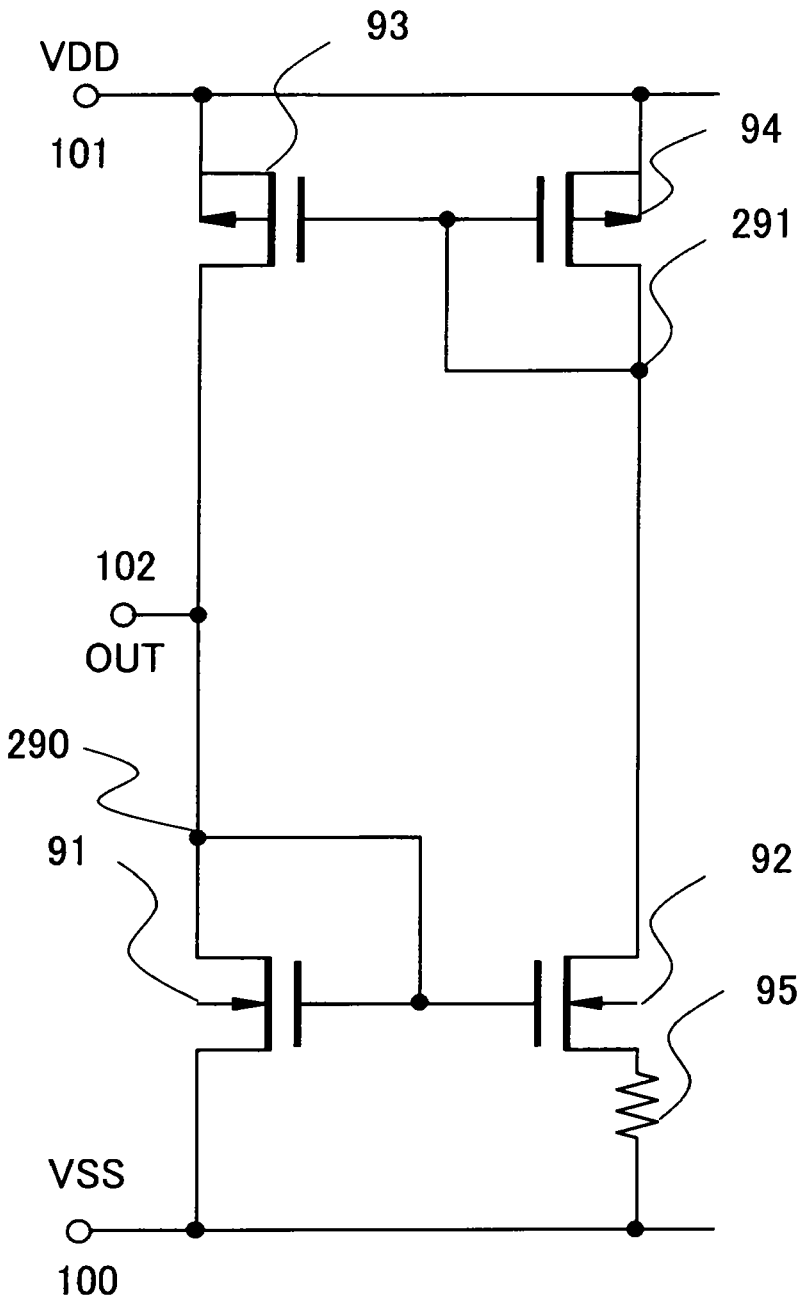
FIG. 9 PRIOR ART
FIG. 9 is a circuit diagram illustrating a configuration example of a conventional constant current circuit.

FIG. 8 is a circuit diagram illustrating an example of a reference voltage circuit using the constant current circuit according to the present invention. The reference voltage circuit of FIG. 8 is exemplified as a circuit using the constant current circuit of FIG. 4. Note that, the constant current circuit may be a circuit illustrated in another example.

The reference voltage circuit of FIG. 8 includes the enhancement mode NMOS transistors 11 and 12 and the resistor 15, which form the constant current source block circuit 112, the depletion mode NMOS transistors 13 and 14, the enhancement mode NMOS transistors 20 and 21 and the enhancement mode PMOS transistors 22 and 23, which form the differential amplifier circuit 111, an enhancement mode PMOS transistor 24, a resistor 16, and a diode 40. The enhancement mode PMOS transistor 24, the resistor 16, and the diode 40 together form a voltage generation circuit.

The constant current source block circuit 112 has the same configuration as that of FIG. 2. The differential amplifier circuit 111 has the same configuration as that of FIG. 4.

The enhancement mode PMOS transistor 23 has a gate terminal connected to a connection point 244, a drain terminal connected to a reference voltage output terminal 106, and a source terminal and a substrate which are connected to the power supply terminal 101. The resistor 16 has one terminal connected to the reference voltage output terminal 106 and another terminal connected to an anode of the diode 40. The diode 40 has a cathode connected to the ground terminal 100.

Next, an operation of the reference voltage circuit of FIG. 8 is described.

The operation of the constant current circuit is the same as described with reference to FIG. 4. Therefore, the differential amplifier circuit 111 provides the same potential at the connection point 242 and the connection point 243, to thereby maintain high stability with respect to input fluctuations. Besides, the use of the depletion mode NMOS transistors 13 and 14 in the current mirror circuit enables the constant current circuit to start up reliably without a start-up circuit.

The bias current of the constant current circuit flows through the resistor 16 and the diode 40 via the enhancement mode PMOS transistor 24. In this case, when the resistor 15 and the resistor 16 are formed of the same type of resistor, the temperature coefficients of the resistors are cancelled out. Therefore, a voltage having a positive temperature coefficient proportional to nkT/q is generated across the resistor 16, where q is the elementary charge, k is the Boltzmann constant, T is the temperature, and n is a process-dependent constant.

On the other hand, a voltage across the diode 40 has a negative temperature coefficient of about −2 mV. In this case, by setting the resistance ratio between the resistor 15 and the resistor 16 so that the temperature coefficient of the voltage across the resistor 16 and the temperature coefficient of the voltage across the diode 40 may be cancelled out, a temperature-independent reference voltage can be obtained across the reference voltage output terminal 106 and the ground terminal 100.

What is claimed is:

1. A constant current circuit, comprising:

a constant current generation circuit comprising NMOS transistors and a resistor;

a current mirror circuit comprising a pair of depletion mode NMOS transistors including gate terminals connected to each other, for allowing a current of the constant current generation circuit to flow; and a feedback circuit for maintaining constant voltages of source terminals of the pair of depletion mode NMOS transistors.

2. A constant current circuit according to claim 1, wherein the feedback circuit comprises a differential amplifier circuit including input terminals connected to the source terminals of the pair of depletion mode NMOS transistors, respectively, and an output terminal connected to the gate terminals of the pair of depletion mode NMOS transistors.

3. A constant current circuit according to claim 2, wherein the constant current generation circuit comprises:

a first NMOS transistor including a drain terminal connected to an inverting input terminal of the differential amplifier circuit, and a source terminal connected to a ground terminal via the resistor; and a second NMOS transistor including a gate terminal and a drain terminal which are connected to a non-inverting input terminal of the differential amplifier circuit and to a gate terminal of the first NMOS transistor, and a source terminal connected to the ground terminal.

4. A constant current circuit according to claim 2, wherein:

the constant current generation circuit comprises:

a first NMOS transistor including a drain terminal connected to an inverting input terminal of the differential amplifier circuit, and a source terminal connected to a ground terminal; and a second NMOS transistor including a gate terminal connected to a non-inverting input terminal of the differential amplifier circuit, and a drain terminal connected to a gate terminal of the first NMOS transistor; and the resistor of the constant current generation circuit includes one terminal connected to the drain terminal of the second NMOS transistor, and another terminal connected to the non-inverting input terminal of the differential amplifier circuit.

5. A reference voltage circuit, comprising:

the constant current circuit according to claim 1; and a voltage generation circuit provided to an output terminal of the constant current circuit.

6. A reference voltage circuit according to claim 5, wherein:

the voltage generation circuit comprises a PMOS transistor, a resistor, and a diode, which are connected in series; and the resistor included in the voltage generation circuit and the resistor included in the constant current generation circuit have the same temperature coefficient.

* * * * *